United States Patent [19]

Davis

[11] 4,120,160

[45] Oct. 17, 1978

[54] POWER GENERATION SYSTEM

[76] Inventor: Rock Davis, P.O. Box 6, Symsonia, Ky. 42082

[21] Appl. No.: 773,487

[22] Filed: Mar. 2, 1977

[51] Int. Cl.[2] ..... F01K 23/00

[52] U.S. Cl. ..... 60/670; 417/339; 122/40

[58] Field of Search ..... 60/643, 645, 651, 670, 60/671; 417/339, 392; 122/40

[56] References Cited

U.S. PATENT DOCUMENTS

| | | | |
|---|---|---|---|
| 1,217,165 | 2/1917 | Fessenden | 60/641 |
| 3,201,031 | 8/1965 | Maglott | 417/339 |
| 4,023,367 | 5/1977 | Izumi | 60/670 |

FOREIGN PATENT DOCUMENTS

| | | | |
|---|---|---|---|
| 1,868,124 | 12/1941 | France | 60/671 |

*Primary Examiner*—Allen M. Ostrager
*Assistant Examiner*—Stephen F. Husar
*Attorney, Agent, or Firm*—William E. Jackson

[57] ABSTRACT

A power generation system having a low pressure source of water, means connected to the source of water for pressurizing the water to a substantially higher pressure, means for forming steam from the pressurized water, and a steam turbine for deriving mechanical motion from the steam. The pressurizing means uses first and second chambers of variable volumes. Valve means are associated with the first and second chambers so that water flows into the first chamber when its volume is expanding but water is not allowed to flow into the first chamber when its volume is contracting. Likewise, the valve means are utilized so that water flows into the second chamber when its volume is expanding but water is not allowed to flow into the second chamber when its volume is contracting. Furthermore, valve means are associated with the first chamber to allow pressurized water to flow out of the first chamber when its volume is contracting. Likewise, valve means are associated with the second chamber to allow pressurized water to flow out of the second chamber when its volume is contracting. Also disclosed are means for expanding the first chamber's volume when the second chamber is contracting to pressurize the water within that chamber, and means for contracting the first chamber's volume to pressurize the water therein when the second chamber's volume is expanding. Also disclosed are means for sensing when the first and second chambers' volumes are at their minimum volumes. The sensing means is connected to operate means for alternatively contracting and expanding the volumes of the first and second chambers so that low pressure water flows into the first chamber when relatively high pressure is flowing out the the second chamber; and so that low pressure water is flowing into the second chamber when relatively high pressure water is flowing out the first chamber. According to the disclosure, the improved pressurizer may be utilized in conjunction with a nuclear energy source.

14 Claims, 3 Drawing Figures

POWER GENERATION SYSTEM

The present invention relates to a power generation system and, more particularly, to such a system which creates mechanical motion from a source of high pressure steam. In certain of its aspects, the present invention utilizes a source of nuclear energy as a component of the means for forming steam from pressurized water.

It is known in the art to provide power generation systems which use water which is changed into steam by nuclear energy. For example, in U.S. Pat. No. 3,435,617, there is disclosed a power plant which includes a boiler heated by decay of a radioactive material, a turbine, a feed-water pump, and a generator driven by the turbine. While the present invention relates to the same general field, wherein a radioactive heat source may be utilized, it is more particularly directed to providing an improved means for pressurizing water prior to utilization in the form of steam.

One object of the present invention is to provide an improved power generation system wherein water can be pressurized by a device which is simple, compact, rugged, and easily fabricated.

Another object of the present invention is to provide an improved power generation system wherein steam is formed by use of a nuclear energy source.

Still a further object of the present invention is to provide a power generation system suitable for use in a wheeled vehicle which is provided with motive power by a steam driven turbine.

Other objects and advantages of the present invention will appear to those skilled in the art from the written description which follows.

In accordance with the present invention, I provide a power generation system which has a low pressure source of water, means connected to the source of water for pressurizing the water to a substantially higher pressure, means for forming steam from the pressurized water, and a steam turbine for deriving mechanical motion from the steam. According to one aspect of the invention, I provide an improved pressurizer which uses first and second chambers having variable volumes. Various valve means are associated with the first and second chambers so that water flows into the first chamber when its volume is expanding but water is not allowed to flow into the first chamber when its volume is contracting. Likewise, the valve means are utilized so that water flows into the second chamber when its volume is expanding but water is not allowed to flow into the second chamber when its volume is contracting. Furthermore, valve means are associated with the first chamber to allow pressurized water to flow out of the chamber when its volume is contracting. Likewise, valve means are associated with the second chamber to allow pressurized water to flow out of the second chamber when its volume is contracting. Further, according to the present invention, I provide a means for expanding the first chamber's volume when the second chamber is contracting to pressurize the water within that chamber; means are also provided for contracting the first chamber's volume to pressurize the water therein when the second chamber's volume is expanding.

Still further according to the present invention I provide means for sensing when the first and second chambers' volumes are at their minimum volumes. The sensing means is connected to operate means for alternatively contracting and expanding the volumes of the first and second chambers so that low pressure water flows into the first chamber when relatively high pressure water is flowing out of the second chamber; and so that low pressure water is flowing into the second chamber when relatively high pressure water is flowing out of the first chamber.

According to a still further aspect of the present invention I utilize moveable pistons within the first and second chambers. These pistons are moved to contract the volume of each chamber through the use of a hydraulic fluid pressure means which exerts alternating hydraulic fluid pressure on the pistons. The hydraulic pressure means may be constructed and arranged to use mechanical energy from the turbine.

According to another aspect of the invention I provide an arrangement of check valves which accomplish the variety of valving functions necessary for operating the improved pressurizer of the present invention.

According to still another aspect of the invention I utilized my improved pressurizer in conjunction with a nuclear energy source and mount the entire system in a wheeled vehicle so that the vehicle may be driven by the steam turbine in the system of my invention.

Figure 1:
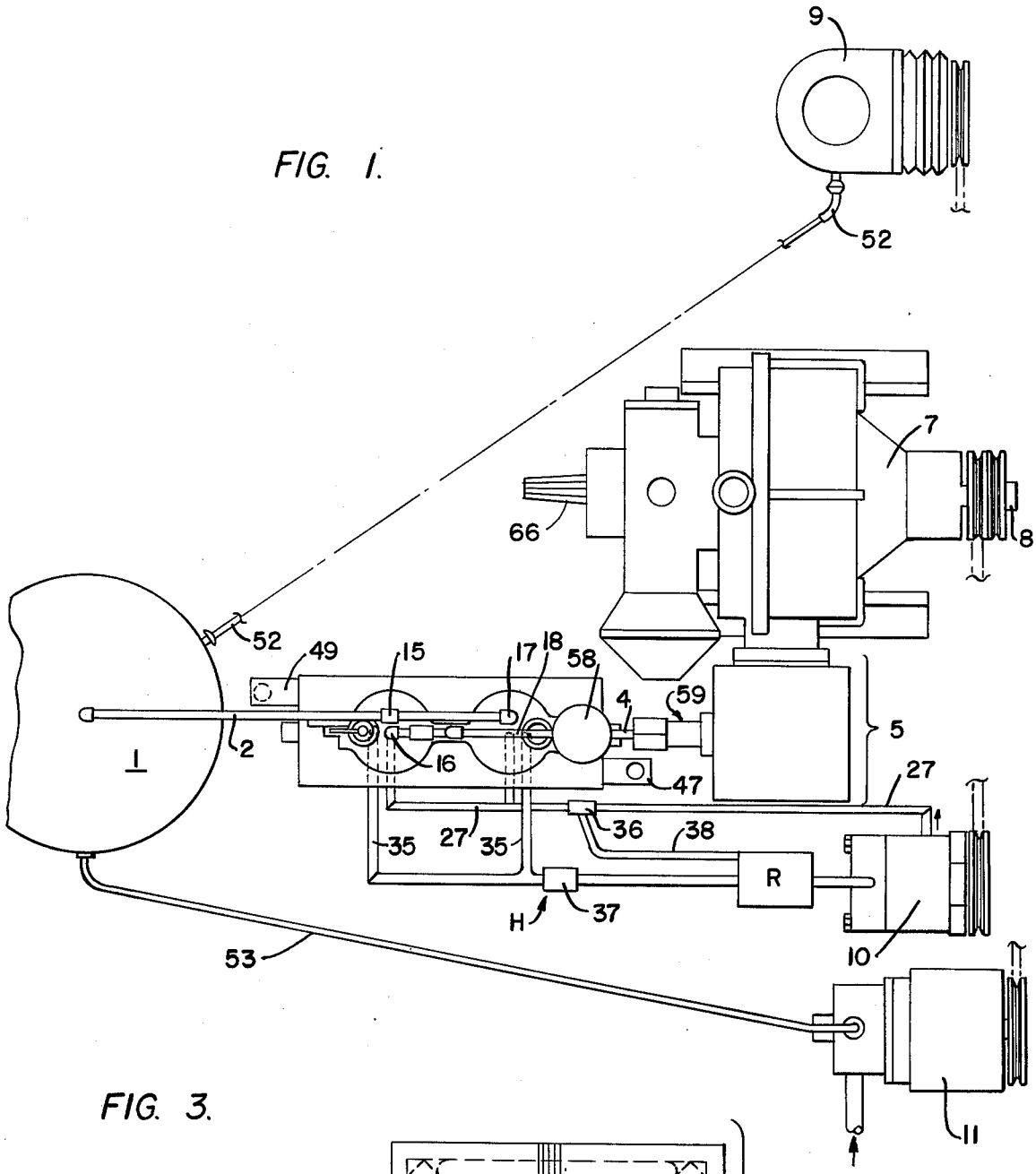
FIG. 1 is a partial plan view of a power generation system in accordance with one embodiment of the present invention.
Figure 2:
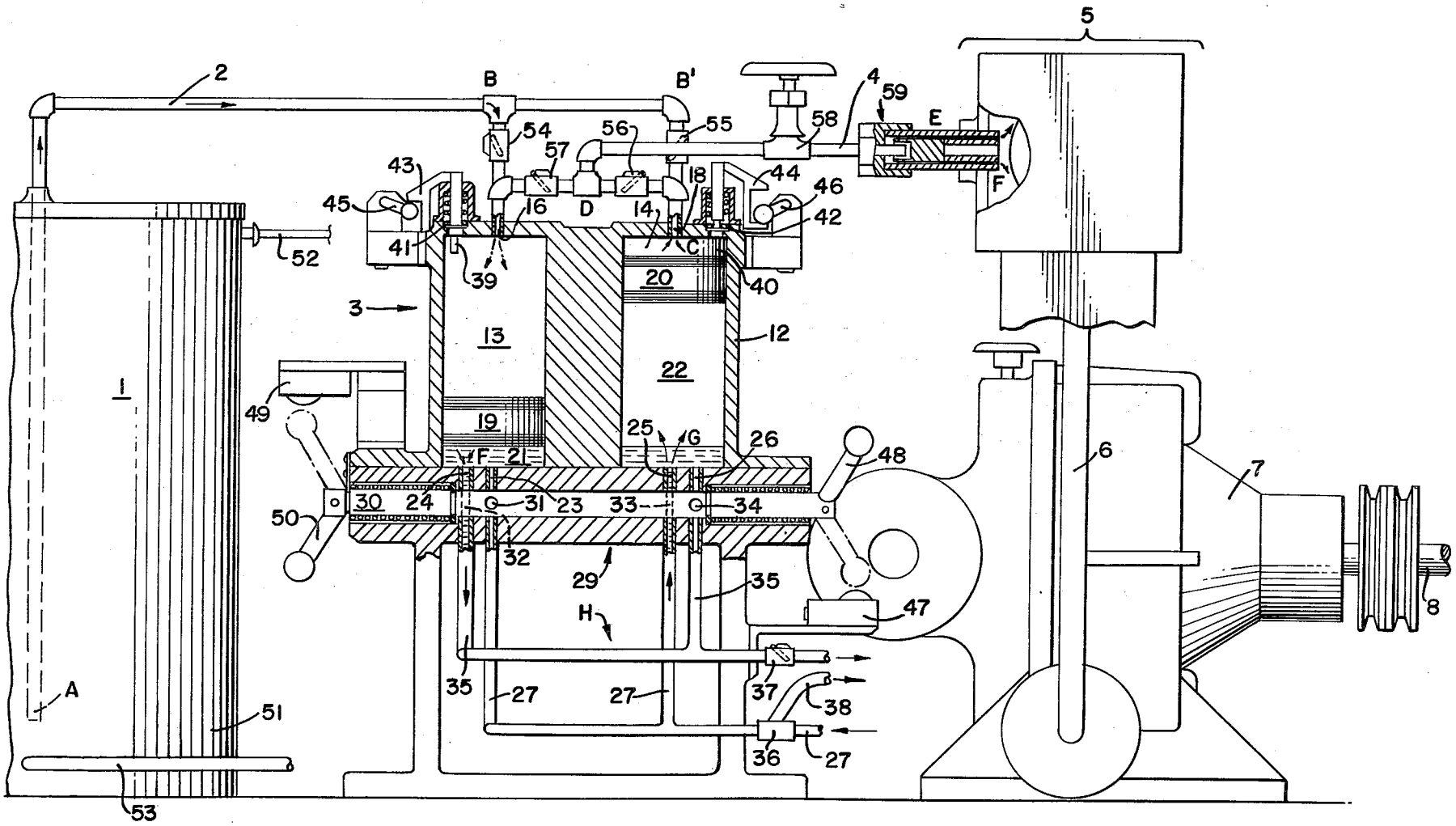
FIG. 2 is an elevation view of the power generation system shown in FIG. 1 with portions broken away or shown in cross-section for purposes of clarity.

For ease of understanding the generalized system of the present invention, reference is made to FIGS. 1 and 2. The power generation system of the present invention has a low pressure source of water 1. Connected to said source 1 by means of pipe 2 is a means 3 for pressurizing the water to a higher pressure. This means 3 is connected by pipe 4 to a means 5 for forming steam from said pressurized water. Means 5 is connected by pipe 6 to a steam turbine 7. As shown in FIG. 1, the output shaft 8 of steam turbine 7 is mechanically connected to an air compressor pump 9, a hydraulic pump 10, and a water pump 11. The functions of these pumps will be described in more detail below.

According to one aspect of the present invention, I provide a water pressurizer means 3 which involves various elements. Means 3 includes a wall means 12 which defines a first chamber 13 and a second chamber 14, both of which have variable volumes. Also, the first chamber 13 has a water intake opening 15 and a water discharge opening 16. In a similar fashion, the second chamber 14 has a water intake opening 17 and a water discharge opening 18. In FIG. 2, the water intake openings for each chamber are aligned behind the water discharge openings, so FIG. 1 more clearly shows the placement of these openings in the wall means 12. Wall means 12 includes a first moveable piston 19 for forming one wall of the first chamber 13. Wall means 12 also includes a second moveable piston 20 for forming one wall of the second chamber 14. Pistons 19 and 20 are constructed and arranged to move up and down so that the volumes of chambers 13 and 14 are variable.

Pressurizer means 3 also includes means for expanding the volume of chamber 13 when the volume of chamber 14 is contracting. In the device shown in FIGS. 1 and 2, this latter means includes a hydraulic fluid pressure system generally designated as H. Basically, the hydraulic fluid pressurre system is constructed and arranged to exert alternating hydraulic fluid pressure on the lower side of pistons 19 and 20. To facilitate this, wall means 12 defines a first hydraulic fluid chamber 21 adjacent the piston 19. Likewise, wall means 12 defines a second hydraulic fluid chamber 22 adjacent the piston 20. Wall means 12 defines an intake opening 23 and an outlet opening 24 for hydraulic fluid chamber 21. Also, wall means 12 defines an intake opening 25 and an outlet opening 26 for hydraulic fluid chamber 22.

The intake openings 23 and 25 are connected through a series of pipes and valves to the hydraulic pressure output from pump 10. The outlet openings 24 and 26 are connected through a series of pipes and valves to allow return of hydraulic fluid to the hydraulic fluid pressure system. For ease of understanding, the hydraulic fluid flow path can be followed from the output of pump 10 and through the pipes and valves to and away from the hydraulic chambers 21 and 22. As seen in FIGS. 1 and 2, hydraulic pump 10 is connected by a pipe 27 to a bypass valve 36 which is, in turn, connected to a rotary valve means generally designated as 29. This rotary valve means includes a rotatable shaft 30 which has a valve opening 31 associated with intake opening 23 for chamber 21 and a valve opening 32 associated with outlet opening 24 for chamber 21. Also, the shaft 30 has a valve opening 33 associated with intake opening 25 for chamber 22 and a valve opening 34 associated with outlet opening 26 for chamber 22. As best seen in FIG. 2, the valve openings in shaft 30 are constructed and arranged so that, depending on the rotational position of shaft 30, hydraulic fluid pressure from pipe 27 will alternatively be applied to intake openings 23 and 25. Also, the valve openings in shaft 30 are constructed and arranged so that the hydraulic fluid will flow out of the outlet openings of one hydraulic chamber when hydraulic pressure is applied to the intake opening of the other hydraulic chamber. Following the hydraulic fluid flow in FIG. 2, the hydraulic fluid will enter chamber 22 to build up pressure under piston 20 because the discharge opening 25 will be closed by valve shaft 30. However, while hydraulic fluid pressure is being applied to chamber 22, the hydraulic fluid in chamber 21 is draining out through discharge opening 24 and valve opening 32 in valve shaft 30. The hydraulic fluid draining from hydraulic fluid chamber 21 is carried by pipe 35 back to the fluid reservoir R near the input of hydraulic pump 10.

In the hydraulic system just described, a bypass valve 36 and a check valve 37 are used to selectively control the hydraulic fluid pressure applied to hydraulic chambers 21 and 22. More specifically, bypass valve 36 can be set to open only when the hydraulic pump 10 has produced a desired pressure at its output. When the desired pressure is exceeded, then bypass valve 36 will merely shunt fluid pressure to the reservoir R by means of pipe 38. The one-way check valve 37 will insure that hydraulic fluid will not flow into pipe 35. Usually, the pressure produced by pump 10 is applied to pipes 27 which communicate with fluid chamber intake openings 23 and 25 depending on the position of valve shaft 30.

The hydraulic fluid pressure system H is connected to a means for sensing when the water chambers 13 and 14 have contracted to their minimum volumes. The sensing means provides a signal which operates the rotation of valve shaft 30 so that it can perform the desired valving function. The sensing means includes pins 39 and 40 which are slidably mounted in walls means 12 and extend from the inside of chambers 13 and 14 to the outside of walls means 12. The pins pass through suitable packing glands 41 and 42. Pins 39 and 40 are mechanically connected to u-shaped actuator arms 43 and 44. These arms embrace the levers of limit switches 45 and 46. As best seen in FIG. 2, when piston 20 approaches the upper portion of chamber 14, the piston engages pin 40 and pushes it upward. This upward movement of pin 40 is translated to the arm of limit switch 46. When the piston 20 reaches the highest desired position, limit switch 46 is actuated. This switch 46 is connected by conventional circuitry (not illustrated) to an electromagnet 47 mounted adjacent an armature 48 mounted on valve shaft 30. Limit switch 45 is similarly connected to an electromagnet 49 mounted adjacent an armature 50 mounted on valve shaft 30. In operation, limit switch 46 is activated when piston 20 has reached its highet point. All during the time that piston 20 has been rising to this point, valve shaft 30 has been in the position shown in FIG. 2 so that hydraulic fluid pressure is continuously applied to chamber 22 through intake opening 25 which is connected to pressure source 27 by valve opening 33 in shaft 30. While shaft 30 is in this position, armature 48 is in its upper position as shown in full lines in FIG. 2. However, when electromagnet 47 is energized, armature 48 is pulled to the lower position shown in phantom lines in FIG. 2. This movement of armature 48 causes valve shaft 30 to rotate 90 degrees, thus causing valve opening 33 to move out of alignment with intake opening 25 and causing valve opening 34 to move into alignment with outlet opening 26. Since the outlet opening 26 is now aligned with valve opening 34, the hydraulic fluid in the chamber 22 flows out through pipe 35 to be returned to the input side of the hydraulic pump 10. Of course, it should be understood that a similar action takes place for chamber 21 when limit switch 45 is activated. In essence, the valve shaft 30 is alternatively moved 90° in one direction and then 90° in another direction as a result of the sensing means and associated electromagnetic actuator circuits.

I will now describe the flow of water through the power generation system of the present invention. Referring to FIGS. 1 and 2, I provide a low pressure source of water 1. This source includes a 50-gallon capacity water tank 51 which contains water under about 50 psi of air pressure. This air pressure is supplied by air compressor 9 which is connected to the tank 51 by a pipe 52. Additional water can be introduced into tank 51 by means of pipe 53 which is connected to water pump 11 which may, in turn, be connected to a suitable source of water (not illustrated). The water in tank 51 flows into pipe 2 at point A and continues to points B and $B^1$. At point B, the pipe 2 is connected to a check valve 54 which is, in turn, connected to the water intake opening of chamber 13. In a similar manner, at point $B^1$, the pipe 2 is connected to a check valve 55 which is, in turn, connected to the water intake opening of chamber 14. Check valves 54 and 55 are constructed and arranged so that they will not open to allow the flow of water into chamber 13 or 14 when these chambers are at a pressure higher than about 50 psi. As shown in FIG. 2, chamber 13 would be expanding and check valve 54 would allow water to flow into chamber 13. However, chamber 14 would be under a relatively higher pressure and check valve 55 would be closed. Thus, in the illustrated phase of operation, all the water would flow into chamber 13.

While chamber 13 fills with water, chamber 14 would be discharging water at point C under a high pressure into pipe 4 which is connected to the water discharge opening 18 by means of a check valve 56. This check valve is constructed and arranged to open due to high pressure on the side toward chamber 14, but to close due to high pressure on the side toward chamber 13. A similar check valve 57 is provided between the discharge opening 16 of chamber 13 and pipe 4. In FIG. 2, valve 56 would be open and valve 57 would be closed due to the pressure differences between chambers 13 and 14. Of course, when the opposite pressure situation is present for chambers 13 and 14, the valves 56 and 57 would be in a reverse situation. From point D, high pressure water would flow through pipe 4 toward the means 5 for forming steam therefrom as is described in more detail below.

Figure 3:
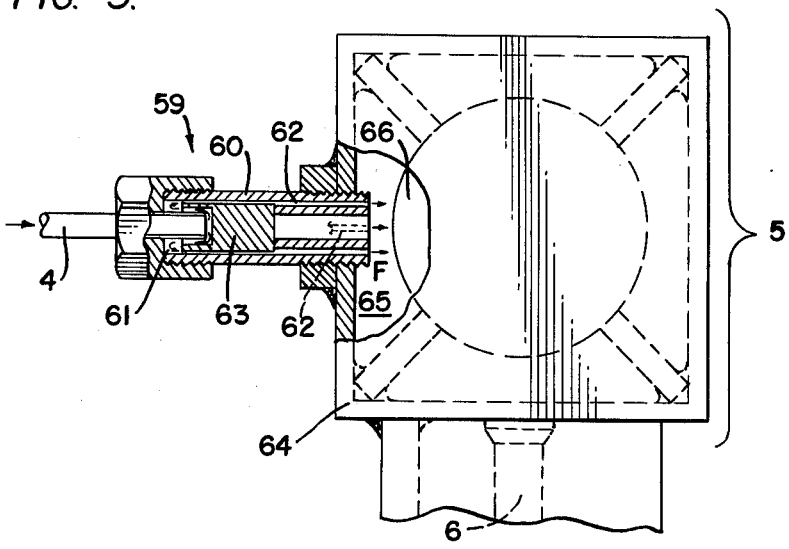
FIG. 3 is a partial view of the apparatus of FIGS. 1 and 2 in which certain portions are shown enlarged and in cross-section.

As high pressure water flows from point D toward the steam forming means 5, it passes through a valve means 58 which is adjustable to control the amount of the water entering slide valve 59. The operation of this valve means 58 will be described in more detail below. After passing through the valve means 58, water flows to point E where it enters steam forming means 5. At point E, the pressurized water enters a slide valve means 59. As best seen in FIG. 3, valve 59 includes a wall means 60 to define a valve chamber 61. The wall means also defines a multiplicity of orifices 62 through which pressurized water is injected into the steam forming means 5. The slide valve 59 also includes an element 63 slidably mounted in chamber 61. The steam forming means 5, as shown in FIG. 3 includes an outer housing 64 forming a chamber 65 into which jets of water are injected from orifices 62. Mounted inside chamber 65 is a source of heat 66, preferably produced by a suitably shielded source of nuclear energy. The specific structural features of the energy source are not shown. But, it should be understood that the preferred form of energy source is compact so that the overall power generation system may be compact enough to be suitable for installation in a wheeled vehicle, as is described in more detail below. Connected to the housing 64 is a pipe 6 which is connected to a steam turbine 7 as illustrated in FIG. 1. Steam produced in housing 64 is thus used to power the turbine 7.

In operation, as high pressure water flows from pressurizer means 3 via pipe 4, it comes to valve 59 which can be in an open or closed state depending upon the difference in pressures between the water in pipe 4 and steam in chamber 65. Thus, if the pressure in chamber 65 is higher at a given instant of time, then element 63 is in the extreme left hand position and water will not enter valve chamber 61. As soon as the steam pressure in chamber 65 drops below the pressure of the water in pipe 4, the element 63 is moved to the right as shown in FIG. 3. When element 63 is in this position pressurized water enters chamber 61 and flows through orifices 62. As high pressure water jets come into chamber 65, they impact on heat source 66 and the water turns to steam in chamber 65. When the steam pressure builds up to a pressure higher than the water pressure, the element 63 again returns to the left. In actual operation, the element 63 is expected to rapidly shift back and forth and the pressure of steam in chamber 65 will remain substantially constant assuming constant heating is provided. Valve 58 can be used in either increase or decrease the flow of water in pipe 4, and this will consequently result in a change of steam pressure in chamber 65 because of the operation slide of valve means 59.

It should be apparent that the power generation system of the present invention may be useful to power a wheeled vehicle. The specific embodiment illustrated in FIG. 1 could be used in an automobile in which case the output shaft 66 of turbine 7 could be connected to a suitable power transmission (not shown) to provide power to the wheels. In the case of a vehicle, valve 58 could be used as an accelerator. Alternatively, the turbine's output shaft 66 could be connected directly to the wheel or wheels of a wheeled vehicle. The power generation system of the present invention may also be useful to generate electricity at a fixed location such as in a home or building. In such use the output shaft 66 of turbine 7 could be used to drive a generator (not illustrated).

The following specific example of the present invention is given for illustrative purposes. It should be understood that variations and modifications can be effected by those skilled in the art within the spirit and scope of the invention as described and as defined in the appended claims. According to the example, pistons 19 and 20 act as spacers between water in the upper chambers 13 and 14 and oil which is used in the hydraulic chambers 21 and 22. Chambers 13 and 14 are designed to each hold 21 gallons of water. The hydraulic system 21 is designed to provide 2000 psi pressure to the oil in chambers 21 and 22. While the oil in one such chamber is under 2000 psi pressure, the oil in the other hydraulic fluid chamber is flowing back into the hydraulic system H. The water chamber over the latter hydraulic chamber is being filled with water which has 50 psi pressure exerted on it in water tank 1. As the water chamber fills under 50 psi pressure, the oil flows under this pressure back into the hydraulic system H. When the piston under 2000 psi oil pressure reaches the top, it activates the limit switch which in turn actuates the rotation valve as described in detail above. The rotation valve then causes the 2000 psi oil pressure to be applied to the hydraulic chamber that is under the water chamber that has just filled. In operation, the pistons 19 and 20 move up and down slowly. For example, several hours may elapse before a piston travels from bottom to top to discharge the 21 gallons of water to be heated. This can be controlled by valve 58 and the sizing of orifices 62. For example, the orifices 62 may be 1/64 of an inch in diameter. It is expected that a temperature from about 500° to 1000° F. at point F would be suitable for the system of this example. This temperature could be provided by a source of nuclear energy which is suitably shielded at the center of a spherical chamber as is generally illustrated in FIG. 3. In particular, the spherical chamber could be of stainless steel material surrounding a quantity of lead which, in turn, surrounds further shielding material (e.g. depleted Uranium) in which the source of nuclear energy (e.g. Uranium) is mounted. The quantity of such source could be selected so that the desired temperature would be provided for the desired length of years. Since slide valve 59 is designed to substantially equalize the pressures of the water in pipe 4 and steam in chamber 65, the steam created in the chamber would be at approximately 2000 psi which could be, in turn, used to power the turbine 7.

I claim:

1. In a power generation system having a low pressure source of water, means connected to said source for pressurizing said water to a substantially high pressure, means for forming steam from said pressurized water, and turbine means for deriving mechanical motion from said steam, the improvement wherein said pressurizer comprises:

(a) wall means defining first and second chambers having variable volume, each chamber having an intake and discharge opening;

(b) first valve means between said source of water and the intake openings of said first and second chambers for permitting water to flow into said first chamber when its volume is expanding and to keep water from flowing into the intake opening of said second chamber when its volume is contracting;

(c) second valve means between said source of water and the intake openings of said first and second chamber for prmitting water to flow into said second chamber when its volume is expanding and to keep water from flowing into the intake opening of said first chamber when its volume is contracting;

(d) third valve means connected to the discharge opening of said second chamber to allow pressurized water to flow out of said second chamber when its volume is contracting;

(e) fourth valve means connected to the discharge opening of said first chamber to allow pressurized water to flow out of said first chamber when its volume is contracting;

(f) means for expanding said first chamber's volume when said second chamber is contracting to pressurize the water therein and for contracting said first chamber's volume to pressurize the water therein when said second chamber's volume is expanding;

(g) means for sensing when said first and second chambers' volumes are at their minimum contracted volume;

(h) means responsive to said sensing means for alternatively contracting and expanding the volumes of said first and second chambers so that low pressure water is flowing into the intake opening of said first chamber when relatively high pressure water is flowing out of the discharge opening of said second chamber to said means for forming steam, and so that low pressure water is flowing into the intake opening of said second chamber when relatively high pressure water is flowing out of the discharge opening of said first chamber to said means for forming steam.

2. The invention of claim 1 wherein said wall means (a) includes a first moveable piston for said first chamber, and a second moveable piston for said second chamber, and said means (f) and (h) include hydraulic fluid pressure means for exerting alternating hydraulic fluid pressure on said pistons to contract the volume of said chambers, said hydraulic pressure means being constructed and arranged to use mechanical energy from said turbine means.

3. The invention of claim 2 wherein sid first valve means (b) includes a check valve in the water line between sad low pressure water source and said intake opening of said first chamber, said check valve being open to allow water to flow when the volume of said first chamber is expanding, and a check valve in the water line between said low pressure water source and said intake opening of said second chamber, said check valve being closed to prevent water flow when the volume of said second chamber is contracting and said chamber contains pressurized water; and said second valve means (c) includes a check valve in the water line between said low pressure water source and said intake opening of said second chamber, said check valve being open to allow water to flow when the volume of said second chamber is expanding, and a check valve in the water line between said low pressure water source and said intake opening of said first chamber, said check valve being closed to prevent water flow when the volume of said chamber is contracting and said chamber contains pressurized water.

4. The invention of claim 3 wherein said hydraulic pressure means includes: wall means defining a first hydraulic fluid chamber adjacent said first piston, and a second hydraulic fluid chamber adjacent said second piston; an intake and outlet opening in each of said first and second hydraulic fluid chambers; hydraulic valve means connected to said intake and outlet openings for alternatively discharging or filling said first and second hydraulic fluid chambers, said hydraulic valve means being responsive to said means (g) for sensing when said first and second chambers' volumes are at their contracted volumes, whereby hydraulic fluid flows out of the outlet of said first hydraulic fluid chamber while pressurized hydraulic fluid flows into the intake opening of said second hydraulic fluid chamber.

5. The invention of claim 4 wherein said hydraulic pressure means includes a pump for pressurizing a hydraulic fluid, a hydraulic line connected from said pump to said intake openings of each of said first and second hydraulic fluid chambers, a bypass valve means mounted in said hydraulic line between said pump and said intake openings, said bypass valve means having means for controlling the hydraulic pressure of the hydraulic fluid applied to said intake openings of said chambers.

6. In a power generation system having a low pressure source of water, means connected to said source for pressurizing said water to a substantially high pressure, means for forming steam from said pressurizied water, and turbine means for deriving mechanical motion from said steam, the improvement wherein said pressurizer comprises:

(a) wall means defining first and second chambers having variable volumes, each chamber having an intake and discharge opening;

(b) first valve means between said source of water and the intake openings of said first and second chambers for permitting water to flow into said first chamber when its volume is expanding and to keep water from flowing into the intake opening of said second chamber when its volume is contracting;

(c) second valve means between said source of water and the intake openings of said first and second chamber for permitting water to flow into said second chamber when its volume is expanding and to keep water from flowing into the intake opening of said first chamber when its volume is contracting;

(d) third valve means connected to the discharge opening of said second chamber to allow pressurized water to flow out of said second chamber when its volume is contracting;

(e) fourth valve means connected to the discharge opening of said first chamber to allow pressurized water to flow out of said first chamber when its volume is contracting;

(f) means for expanding said first chamber's volume when said second chamber is contracting to pressurize the water therein and for contracting said first chamber's volume to pressurize the water therein when said second chamber's volume is expanding;

(g) means for sensing when said first and second chambers' volumes are at their minimum contracted volume;

(h) means responsive to said sensing means for alternatively contracting and expanding the volumes of said first and second chambers so that low pressure water is flowing into the intake opening of said first chamber when relatively high pressure water is flowing out of the discharge opening of said second chamber, and so that low pressure water is flowing into the intake opening of said second chamber when relatively high pressure water is flowing out of the discharge opening of said first chamber; and (i) pipe means connected to said third and fourth valve means (d and e), said pipe means being adapted to conduct pressurized water to a slide valve means connected to said means for forming steam; said slide valve means having wall means to define a valve chamber and a multiplicity of orifices through which pressurized water is injected into said steam forming means, said slide valve means having an element slidably mounted in said valve chamber, whereby said slide valve is alternatively opened and closed due to pressure differences between said pressurized water entering said slide valve and the steam formed from said injected water.

7. The invention of claim 1 wherein said means for forming steam includes a source of nuclear energy.

8. The invention of claim 7 wherein said power generation system is mounted in a wheeled vehicle and said mechanical motion from said turbine is used to propel said vehicle.

9. The invention of claim 7 wherein said turbine means is connected directly to a wheel of said wheeled vehicle.

10. The invention of claim 2 wherein a water pump means is connected to said low pressure source of water to pressurize said water source, said water pump means being constructed and arranged to use mechanical energy from said turbine means.

11. In a power generation system having a low pressure source of liquid, means connected to said source for pressurizing said liquid to a substantially high pressure, means for forming vapor from said pressurized liquid, and turbine means for deriving mechanical motion from said vapor, the improvement wherein said pressurizer comprises:

(a) wall means defining first and second chambers having variable volumes, each chamber having an intake and discharge opening;

(b) first valve means between said source of liquid and the intake openings of said first and second chambers for permitting liquid to flow into said first chamber when its volume is expanding and to keep liquid from flowing into the intake opening of said second chamber when its volume is contracting;

(c) second valve means between said source of liquid and the intake opening of said first and second chambers for permitting liquid to flow into said second chamber when its volume is expanding and to keep liquid from flowing into the intake opening of said first chamber when its volume is contracting;

(d) third valve means connected to the discharge opening of said second chamber to allow pressurized liquid to flow out of said second chamber when its volume is contracting;

(e) fourth valve means connected to the discharge opening of said first chamber to allow pressurized liquid to flow out of said first chamber when its volume is contracting;

(f) means for expanding said first chamber's volume when said second chamber is contracting to pressurize the liquid therein and for contracting said first chamber's volume to pressurize the liquid therein when said second chamber's volume is expanding;

(g) means for sensing when said first and second chambers' volumes are at their minimum contracted volume;

(h) means responsive to said sensing means for alternatively contracting and expanding the volumes of said first and second chambers so that low pressure liquid is flowing into the intake opening of said first chamber when relatively high pressure liquid is flowing out of the discharge opening of said second chamber, and so that low pressure liquid is flowing into the intake opening of said second chamber when relatively high pressure liquid is flowing out of the discharge opening of said first chamber; and (i) pipe means connected to said third and fourth valve means (d and e), said pipe means being adapted to conduct pressurized liquid to a slide valve means connected to said means for forming vapor; said slide valve means having wall means to define a valve chamber and a multiplicity of orifices through which pressurized liquid is injected into said vapor forming means, said slide valve means having an element slidably mounted in said valve chamber, whereby said slide valve is alternatively opened and closed due to pressure differences between said pressurized liquid entering said slide valve and the vapor formed from said injected liquid.

12. The invention of claim 11 wherein said wall means (a) includes a first moveable piston for said first chamber, and a second moveable piston for said second chamber, and said means (f) and (h) include hydraulic fluid pressure means for exerting alternating hydraulic fluid pressure on said pistons to contract the volumes of said chambers, said hydraulic pressure means being constructed and arranged to use mechanical energy from said turbine means.

13. The invention of claim 12 wherein said first valve means (b) includes a check valve in the liquid line between said low pressure liquid source and said intake opening of said first chamber, said check valve being open to allow liquid flow when the volume of said first chamber is expanding, and a check valve in the liquid line between said low pressure liquid source and said intake opening of said second chamber, said check valve being closed to prevent liquid flow when the volume of said second chamber is contracting and said chamber contains pressurized liquid; and said second valve means (c) includes a check valve in the liquid line between said low pressure liquid source and said intake opening of said second chamber, said check valve being open to allow liquid to flow when the volume of said second chamber is expanding, and a check valve in the liquid line between said low pressure liquid source and said intake opening of said first chamber, said check valve being closed to prevent liquid flow when the volume of said chamber is contracting and said chamber contains pressurized liquid.

14. The invention of claim 13 wherein said hydraulic pressure means includes: wall means defining a first hydraulic fluid chamber adjacent said first piston, and a second hydraulic fluid chamber adjacent said second piston; an intake and outlet opening in each of said first and second hydraulic fluid chambers; hydraulic valve means connected to said intake and outlet openings for alternatively discharging or filling said first and second hydraulic fluid chambers, said hydraulic valve means being responsive to said means (g) for sensing when said first and second chambers' volumes are at their minimum contracted volumes, whereby hydraulic fluid flows out of the outlet of said first hydraulic fluid chamber while pressurized fluid flows into the intake opening of said second hydraulic fluid chamber.

* * * * *